US011713763B2

(12) United States Patent
Argentini et al.

(10) Patent No.: US 11,713,763 B2
(45) Date of Patent: Aug. 1, 2023

(54) OIL-INJECTED SCREW COMPRESSOR

(71) Applicant: TM.I.C. S.R.L. TERMOMECCANICA INDUSTRIAL COMPRESSORS, La Spezia (IT)

(72) Inventors: Enrica Argentini, La Spezia (IT); Paolo Tanzini, La Spezia (IT)

(73) Assignee: TM.I.C. S.R.L. TERMOMECCANICA INDUSTRIAL COMPRESSORS, La Spezia (IT)

( * ) Notice: Subject to any disclaimer, the term of this patent is extended or adjusted under 35 U.S.C. 154(b) by 568 days.

(21) Appl. No.: 16/837,290

(22) Filed: Apr. 1, 2020

(65) Prior Publication Data

US 2020/0309133 A1 Oct. 1, 2020

(30) Foreign Application Priority Data

Apr. 1, 2019 (IT) ..... 102019000004869

(51) Int. Cl.

| | |
|---|---|
| ***F04C 29/00*** | (2006.01) |
| ***F04C 29/02*** | (2006.01) |
| ***F25B 43/02*** | (2006.01) |
| ***F04B 27/10*** | (2006.01) |
| ***F17C 1/14*** | (2006.01) |

(52) U.S. Cl.

CPC ..... *F04C 29/026* (2013.01); *F04C 29/0092* (2013.01); *F17C 1/14* (2013.01); *F04C 2240/30* (2013.01); *F17C 2205/0391* (2013.01); *F17C 2227/0164* (2013.01); *F17C 2265/012* (2013.01); *F17C 2265/015* (2013.01)

(58) Field of Classification Search

CPC ..... F04B 39/16; F04B 27/109; F25B 43/02; F04C 29/02; F04C 29/026; F04C 18/16; F04C 2240/102

See application file for complete search history.

(56) References Cited

U.S. PATENT DOCUMENTS

| | | | | |
|---|---|---|---|---|
| 3,902,827 A | | 9/1975 | Schibbye | |
| 4,420,293 A | * | 12/1983 | Hofmann | F04C 23/00 418/101 |
| 5,795,136 A | | 8/1998 | Olsaker et al. | |
| 6,010,320 A | * | 1/2000 | Kwon | F04C 23/00 184/6.16 |

(Continued)

FOREIGN PATENT DOCUMENTS

| | | | |
|---|---|---|---|
| DE | 3512961 | A1 | 10/1986 |
| DE | 102017100537 | A1 | 3/2018 |

*Primary Examiner* — Deming Wan

(74) *Attorney, Agent, or Firm* — Cantor Colburn LLP

(57) ABSTRACT

A screw compressor includes a hollow casing inside which a reservoir for air and oil is realized and on which, in an upper position, a suction group for air from outside the reservoir having at least an air intake valve and at least an air filter; on one lateral end a flow block provided with an oil/air separation device and an oil filter and at least a valve for extracting compressed air are disposed. The casing is provided with an opening on the opposite side with respect to that on which the flow block is provided.

The compressor includes a casing closure flange to which a screw compression unit is fixed that when the flange is placed to close the opening causes the insertion into the reservoir of the unit.

9 Claims, 2 Drawing Sheets

(56) References Cited

U.S. PATENT DOCUMENTS

| | | | | |
|---|---|---|---|---|
| 6,237,362 | B1 | 5/2001 | Jang | |
| 2014/0017110 | A1* | 1/2014 | Zemliak | F04C 29/026 418/89 |
| 2018/0066796 | A1 | 3/2018 | Heon et al. | |

* cited by examiner

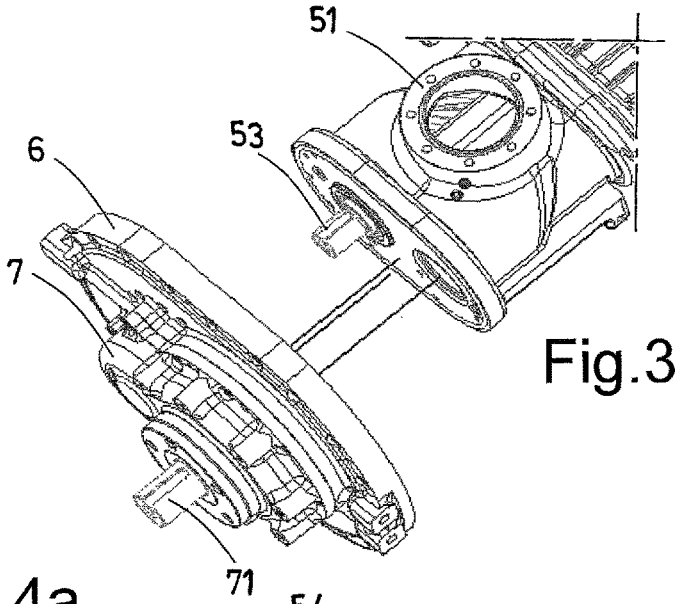
Fig.3
Fig.4a
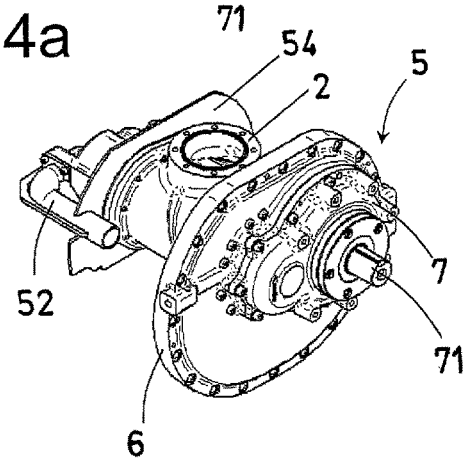
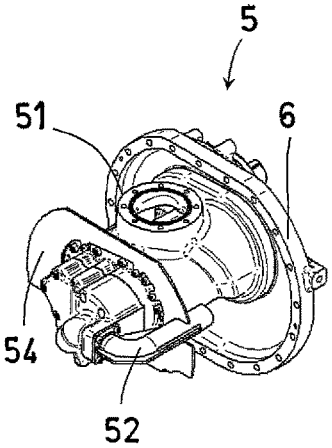
Fig.4b
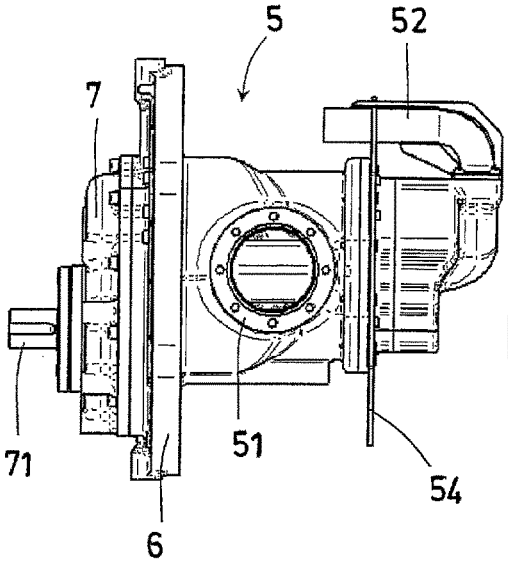
Fig.5
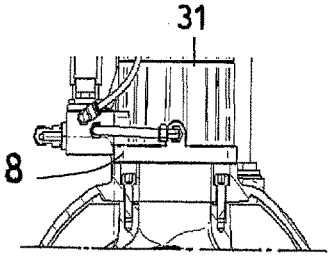
Fig.6

OIL-INJECTED SCREW COMPRESSOR

CROSS-REFERENCE TO RELATED APPLICATIONS

This application is related to, and claims the benefit of, Italian Patent Application No. 102019000004869, filed on Apr. 1, 2019, the contents of which are hereby incorporated by reference in their entirety.

TECHNICAL FIELD

The present disclosure relates to an oil-injected screw compressor. In particular, the present disclosure relates to a compact and integrated compressor, in which the main components (rotors, bearings and bodies) are inserted inside a separate tank, but independent of the pumping element. This allows creating a versatile solution, in which, for the same performance required of the pumping element, it is possible to modify the geometry, the volume, the dimensions and the materials of the tank and/or of the internal elements.

BACKGROUND

Oil-injected screw compressors are volumetric type machines, which obtain gas compression through the simultaneous rotation and translation of the volume created by the relative meshing of the two coupled rotors. It is possible to obtain rather high compression ratios in a single stage (even up to 20-25 for standard machines) thanks to the injection of lubrication oil, for the surfaces of the contact rotor profiles, of refrigeration one, to guarantee temperatures at the exit from the machine within limits that are acceptable for the used materials and for the sealing among moving parts relative to each other.

The compression unit comprising the rotating parts (the rotors or screws) and the electric motor where high pressure is generated can be separated or integrated into the tank where the air and/or oil under pressure is accumulated and where the other parts of the compressor such as oil-air separation filters and various pipes are located.

Currently the solutions available on the market in the field of screw compressors are mainly divided into free shaft machines (only units for compression with external tank/separator, connected via pipes of the plant, or more compact solutions in which the separator tank for oil collection is directly connected to the compression unit.

Integrated solutions are also known in which the compression unit is placed inside the separation tank as described in patent application US2018066796A1. In them there is a tank or casing with a substantially tubular shape inside which the unit that generates the compression is placed. The suction air is conveyed to the compression unit through valves located on the side wall of the tank and connected to this unit by means of pipes inside the tank itself.

In the context of these integrated solutions, one of the most important problems is that of how to comfortably access the internal parts of the compression unit located in the tank, for example to carry out maintenance, replace or repair the rotating parts, which are those more at risk of wear. For example, in the aforementioned patent application, access can be made only by removing the two opposing covers and then by separating the parts connected to the compression unit and finally removing the brackets that fix the unit inside the tubular tank.

SUMMARY

The present disclosure aims to solve these problems by proposing a compressor in which the compression unit is inserted in the tank in a way that can be completely removed from the external casing. Furthermore, by changing the geometries of the tank, it is therefore possible to keep the geometry of the compression unit unchanged.

An aspect of the present disclosure relates to a screw compressor having the characteristics of claim 1.

BRIEF DESCRIPTION OF THE DRAWINGS

The characteristics and advantages of the present disclosure will be clearer and evident from the following illustrative and non-limiting description, of an embodiment, with reference to the attached figures wherein:

FIG. 3 is a perspective view of the compression unit and of the flange for fixing it to the outer casing of the compressor according to the present disclosure;

FIGS. 4*a* and 4*b* are perspective views, as well taken from two opposite angles of the compression unit;

FIG. 5 is a top view of the compression unit joined to the fixing flange according to the present disclosure; and FIG. 6 shows a detail of the connection area between the suction unit and the suction draft of the compression unit.

DETAILED DESCRIPTION OF THE DRAWINGS

Figure 1:
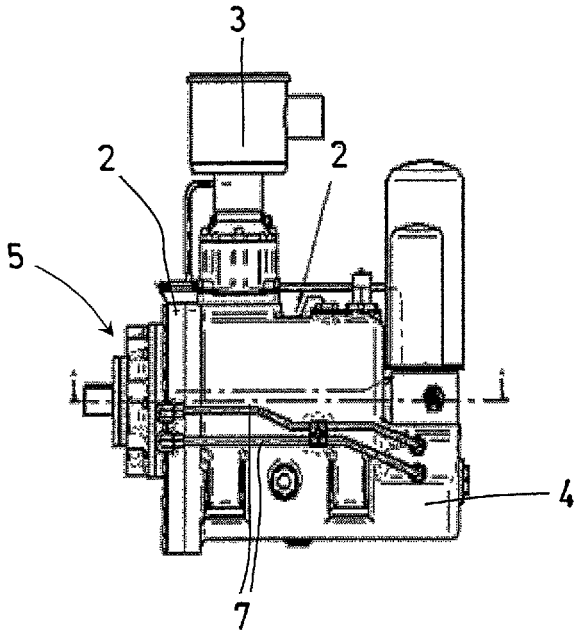
FIG. 1 is a side view of the compressor according to the present disclosure.
Figure 2:
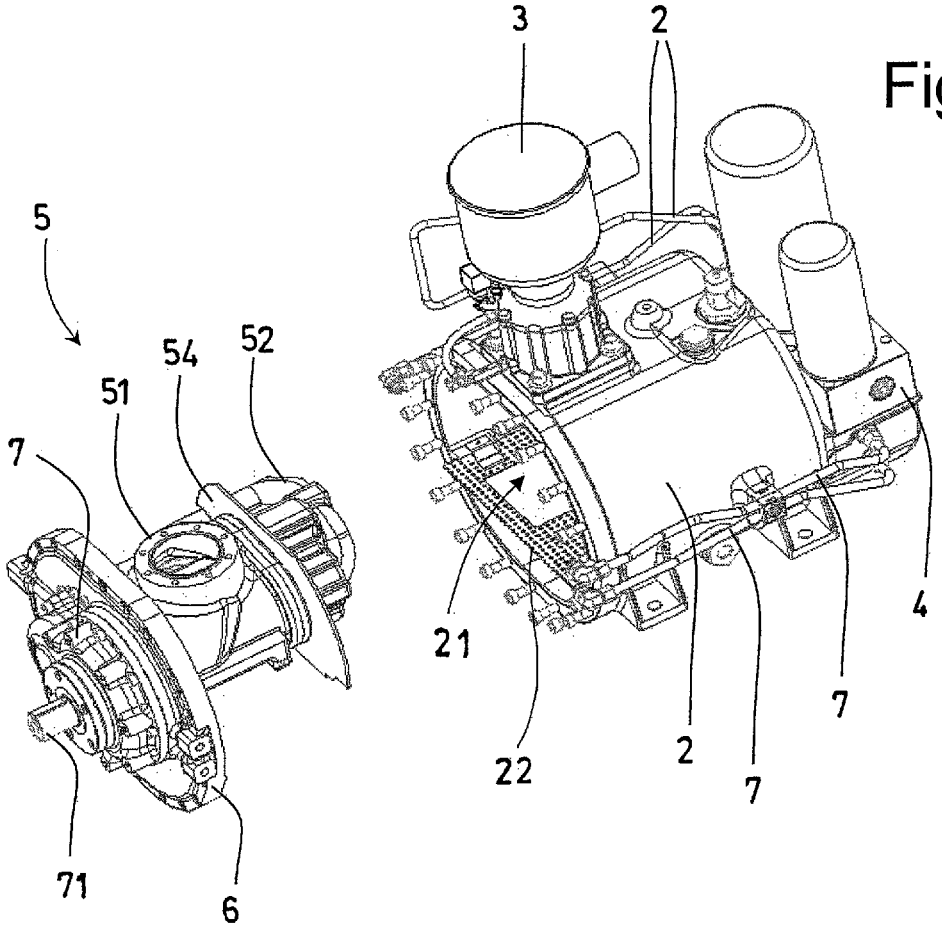
FIG. 2 is an exploded perspective view of the compressor according to the present disclosure.

With reference to the aforementioned figures, the compressor according to the present disclosure comprises a hollow casing 2 inside which reservoir for air and oil is realized and on which, in an upper position, a suction group 3 for air from outside the reservoir comprising at least an air intake valve and at least an air filter; on one lateral end a flow block 4 provided with an oil/air separation device and an oil filter and at least a valve for extracting compressed air are disposed. Said casing is provided with an opening 21 on the opposite side with respect to the said on which the flow block is provided. The compressor comprises a screw compression unit 5 and a first casing closure flange 6 to which said screw compression unit is fixed that when the flange is placed to close the opening 21 causes the insertion into the reservoir of said unit.

The position of the unit in the reservoir is such as to make one of its suction opening 51 matching the intake valve 31 of the tank and to allow one of its flow pipe 52 to pump compressed air into the reservoir.

By changing the geometry of the reservoir, it is therefore possible to keep the geometry of the pumping element unchanged.

The casing is preferably made of a substantially cylindrical shape with an open base and the first flange is substantially a closing disk of this base.

A crankcase 7 is fixed externally to said first flange, provided with a rotation shaft 71 to which motor means are associated (not shown) and inside which there is a gear assembly determining a reduction ratio between this rotating shaft and the transmission shaft 53 of the rotation to the unit 5 screw.

Advantageously, this crankcase can be removable and replaced with one having a different reduction ratio depending on how the compressor as a whole is to be designed. For example, it allows changing the speed, therefore the flow rate of the internal compressor. The crankcase is therefore integrated in the reservoir flange/cover, which can be isolated from the compression unit.

The flow pipe 52 is advantageously U-shaped so as to transfer the compressed air/oil mixture from the screw inside the unit toward the first flange or cover.

It is provided a separation septum 54 in the body of the unit 5 in an intermediate position, suitable to guarantee an efficient separation and recovery process of the oil.

Oil circulation pipes 7 are made on opposite sides of the casing.

Inside the tank, the internal septums are not associated with the reservoir but directly with the unit, this allows both an efficient separation process and an easy unit insertion and extraction process. This also allows to be able to modify the materials and geometries of the unit 5, in relation to the needs, without modifying the external casing.

The connection between the suction mouth 51 and the suction unit is carried out by means of a second flange 8, so that the hermeticity is guaranteed in this connection area, where parts subjected to high pressure are present.

The connections for fixing the compression unit 5 to the casing are both on the side of the first flange/cover 6 of the tank and on the suction mouth, via the second flange 8.

Inside the reservoir 21 it is provided a sheet 22 arranged along a longitudinal direction with respect to the reservoir in an intermediate position between the lower area of oil accumulation and the upper area used for the separation of the air and oil mixture. Advantageously, this sheet is extractable since it is supported by side rails integrally provided on the tank allowing it to slide.

Through appropriate gaskets and sizing of the flanges, it is also possible to use different materials between the compression unit and the other components, optimizing their choice as a function of the specific requests. Compared to standard solutions, the proposed machine version requires, in order to obtain these advantages, the resolution of some substantial sealing and mechanical resistance problems, in particular related to fatigue, as regards the connection screws with the tank and the cover of the same tank. The compression unit, completely immersed in the delivery fluid, under pressure, must be isolated to guarantee the sealing with the suction area (approximately atmospheric pressure), at the suction mouth and the passage of the transmission shaft. The sealing between these areas under different pressure is guaranteed through the appropriate choice of o-rings and connection screws, sized to resist static, pressure and temperature, and dynamic deformations, in particular by checking their fatigue resistance, linked to thermal transients that are frequent in use. The possibility of adopting different materials for the connected elements (for example, the core of the compression unit made of cast iron and the tank and cover made of aluminium), does not induce due to the different coefficients of thermal expansion any stress on the structure as a whole.

Being completely independent of the compression unit, the tank can be modified, in relation to specific application needs, such as requests for a greater oil flow, for example by changing its geometry, or reducing the overall weight, choosing instead lighter materials. The parts that are most sensitive to problems of mechanical resistance or thermal expansion can be made of more resistant materials, always guaranteeing the reliability of the machine. In particular, thanks to this new solution, it has been possible to make the compression unit and the housings of the bearings with materials for standard applications, to guarantee the performance of the machine in relation to operating pressure and temperatures, while it has been possible to make the other components in different materials, after checking, also in this case, the problems of sealing and differential thermal expansion at the interface.

In case of applications under different pressures, the tank can be optimized in the definition of the thicknesses in relation to defined intervals, thus optimizing their overall costs and weights, without resorting to making a more complex component, in which the rotor seat is also located.

During the review of the compressor or mechanical problems, mainly related to the breakage of the bearings, contained inside the compression unit, i.e. the pumping core, it is possible, thanks to this assembly philosophy, to replace the pumping group with a new one also in situ that has been previously and separately assembled.

The invention claimed is:

1. A compressor comprising: a hollow casing within which a reservoir for air and oil is realized and on which, in an upper position, a suction group for air from outside the reservoir comprising at least an air intake valve and at least an air filter, on one lateral end a flow block provided with an oil/air separation device and an oil filter and at least a valve for extracting compressed air are disposed, said casing being provided with an opening on the opposite side with respect to the said on which the flow block is provided, wherein a first flange to which a screw compression unit is fixed that when the first flange is placed to close the opening causes the insertion into the reservoir of said unit, wherein inside the reservoir a sheet is provided arranged along a longitudinal direction with respect to the reservoir in an intermediate position between the lower area of oil accumulation and the upper area used for the separation of the air and oil mixture, said sheet being extractable since said sheet is supported by side rails integrally provided on the casing allowing said sheet to slide.

2. The compressor according to claim 1, wherein the position of the screw compression unit in the reservoir is such as to make one of a suction opening matching the intake valve of the casing and to allow one tube of a plurality of tubes flow to pump compressed air into the reservoir.

3. The compressor according to claim 2, wherein a connection between the suction opening and the suction unit is carried out using a second flange, so that the hermeticity is guaranteed in this connection area, where parts are subjected to high pressure.

4. The compressor according to claim 3, wherein the connections for fixing the compression unit to the casing are both on the side of the first flange/cover of the casing and on the suction mouth, via the second flange.

5. The compressor according to claim 1, wherein the casing has substantially cylindrical shape with an open base and the first flange is substantially a closing disk of said base.

6. The compressor according to claim 1, wherein a crankcase is fixed externally to said first flange, provided with a rotation shaft to which motor means are associated and inside which there is a gear assembly determining a reduction ratio between the rotating shaft and a transmission shaft of the rotation to the screw compression unit.

7. The compressor according to claim 6, wherein said crankcase is removable and replaceable with one having a different reduction ratio.

8. The compressor according to claim 1, wherein the flow pipe is U-shaped so as to transfer the compressed air/oil mixture from the screw inside the unit toward the first flange or cover.

9. The compressor according to claim 1, wherein it is provided a separation septum in a body of the screw compression unit in an intermediate position, configured to guarantee an efficient separation and recovery process of the oil.

* * * * *